US005564122A

United States Patent [19]

Wagner

[11] Patent Number: 5,564,122

[45] Date of Patent: Oct. 15, 1996

[54] HOCKEY GOALTENDER'S BLOCKER WITH ANGLED UPPER AREA

[75] Inventor: Steven G. Wagner, Kitchener, Canada

[73] Assignee: Canstar Sports Group, Inc., Canada

[21] Appl. No.: 265,280

[22] Filed: Jul. 1, 1994

[51] Int. Cl.[6] ..... A41D 13/10

[52] U.S. Cl. ..... 2/16; 2/161.1

[58] Field of Search ..... 2/2, 16, 161.1, 2/18, 20, 159, 161.6

[56] References Cited

U.S. PATENT DOCUMENTS

| | | | |
|---|---|---|---|
| D. 257,909 | 1/1981 | Brine | 2/16 X |
| 3,625,515 | 12/1971 | Murray | 2/16 |
| 4,417,359 | 11/1983 | Johnson | 2/16 |
| 4,700,404 | 10/1987 | Lesperance | 2/16 |

FOREIGN PATENT DOCUMENTS

| | | | |
|---|---|---|---|
| 4406066 | 7/1994 | Germany | 2/16 |

*Primary Examiner*—Paul C. Lewis

*Attorney, Agent, or Firm*—Finnegan, Henderson, Farabow, Garrett & Dunner

[57] ABSTRACT

The goaltender's blocker has an angled upper area, with the inside edge of the blocker being raised more than the outside edge. The angled upper area thus angles outwardly away from the plane of the rest of the blocking pad, and also towards the outside edge. One result of this configuration is that when the goaltender is in the usual upright position with the blocker oriented generally upright, a puck which hits the angled portion of the blocker will be deflected outwardly, i.e. toward the corner of the hockey rink, instead of rebounding in front of the net where a goal may be scored by an offensive player.

3 Claims, 6 Drawing Sheets

FIG.4.
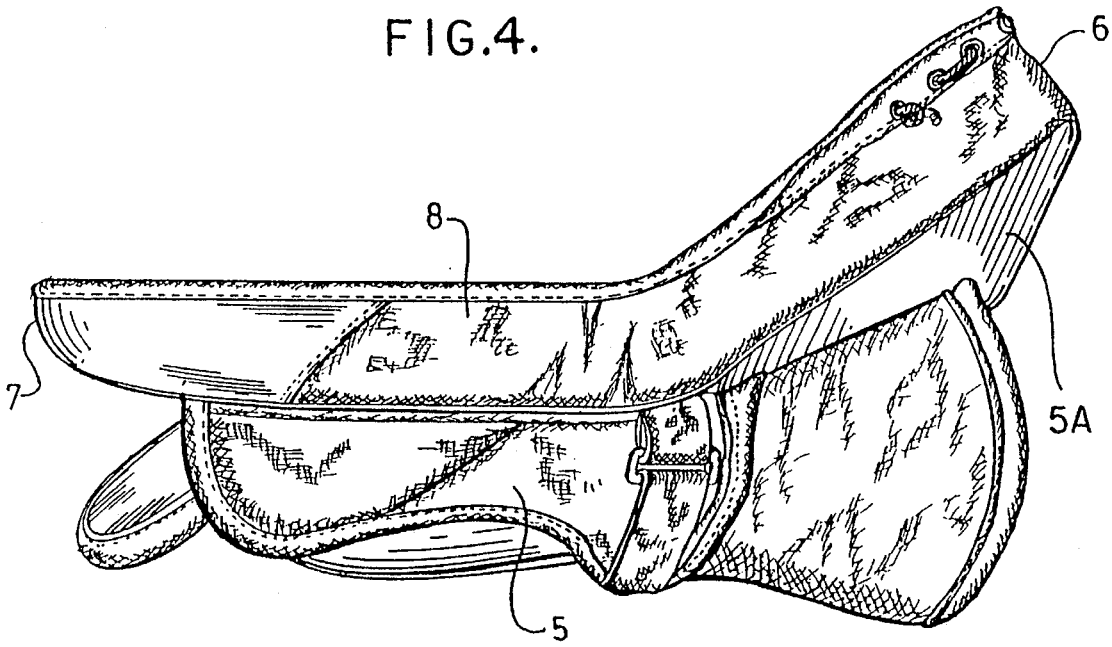
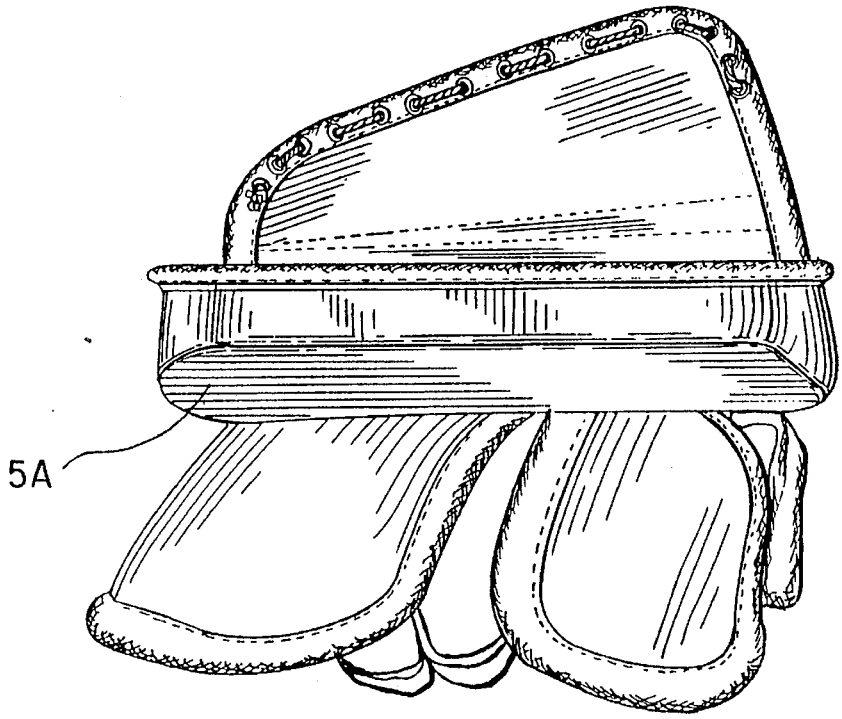
FIG.5.

HOCKEY GOALTENDER'S BLOCKER WITH ANGLED UPPER AREA

BACKGROUND OF THE INVENTION

1. Field of the Invention

This invention relates to hockey goaltender's blockers, and particularly to such blockers which have a contoured upper area.

2. Description of the Prior Art

Traditional goaltender's blockers had a flat outer surface. However, in recent years, it has become common for the upper end of the blocker to be curled outwardly, as shown for example in U.S. Pat. No. 4,700,404, for example. The advantage such blockers have over the traditional flat blockers is that the puck can be more easily deflected away from the net than with a more conventional flat blocker.

In all blockers known to the inventor, the curl is consistent from one side of the blocker to the other. That is, the vertical cross-section remains the same from one side edge to the other side edge.

SUMMARY OF THE INVENTION

In the invention, a novel configuration for the curled end is employed, in which the curled portion is angled, by virtue of the inside edge being raised more than the outside edge. The result of this configuration is that when the goaltender is in the usual upright position with the blocker oriented generally upright, a puck which hits the angled portion of the blocker will be deflected outwardly, i.e. toward the corner of the hockey rink, instead of rebounding in front of the net where a goal may be scored by an offensive player. If the goaltender reaches out away from his body with the blocker, a puck hitting the angled portion will be deflected upwardly and thus out of harm' way. If the goaltender brings the blocker up across his chest (an unusual but possible position), a puck hitting the angled portion will be deflected downwardly, where it may be "smothered" by the goaltender.

Thus, no matter how the blocker is oriented, a puck hitting the angled area will be deflected in a more desirable direction than with prior art blockers.

It is a further advantage of this configuration that if a shot is directed towards the shoulder area on the blocker side, such that the goaltender has to move the blocker up to his shoulder, the angled area is less likely to snag on the goaltender's chest protector or shoulder pads than in the prior art, because the angled area projects away therefrom.

In the blocker, the area adjacent the upper end of the blocking pad is angled outwardly away from the plane of the rest of the blocking pad, preferably at an angle of about 45 degrees, and towards the outside edge, preferably at an angle of about 25 degrees. The angled area preferably accounts for about 25% of the total surface area of the blocker.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which:

FIG. 4 is a side view of the blocker, looking towards the inside edge;

FIG. 5 is an end view, from the lower edge;

Figure 1:
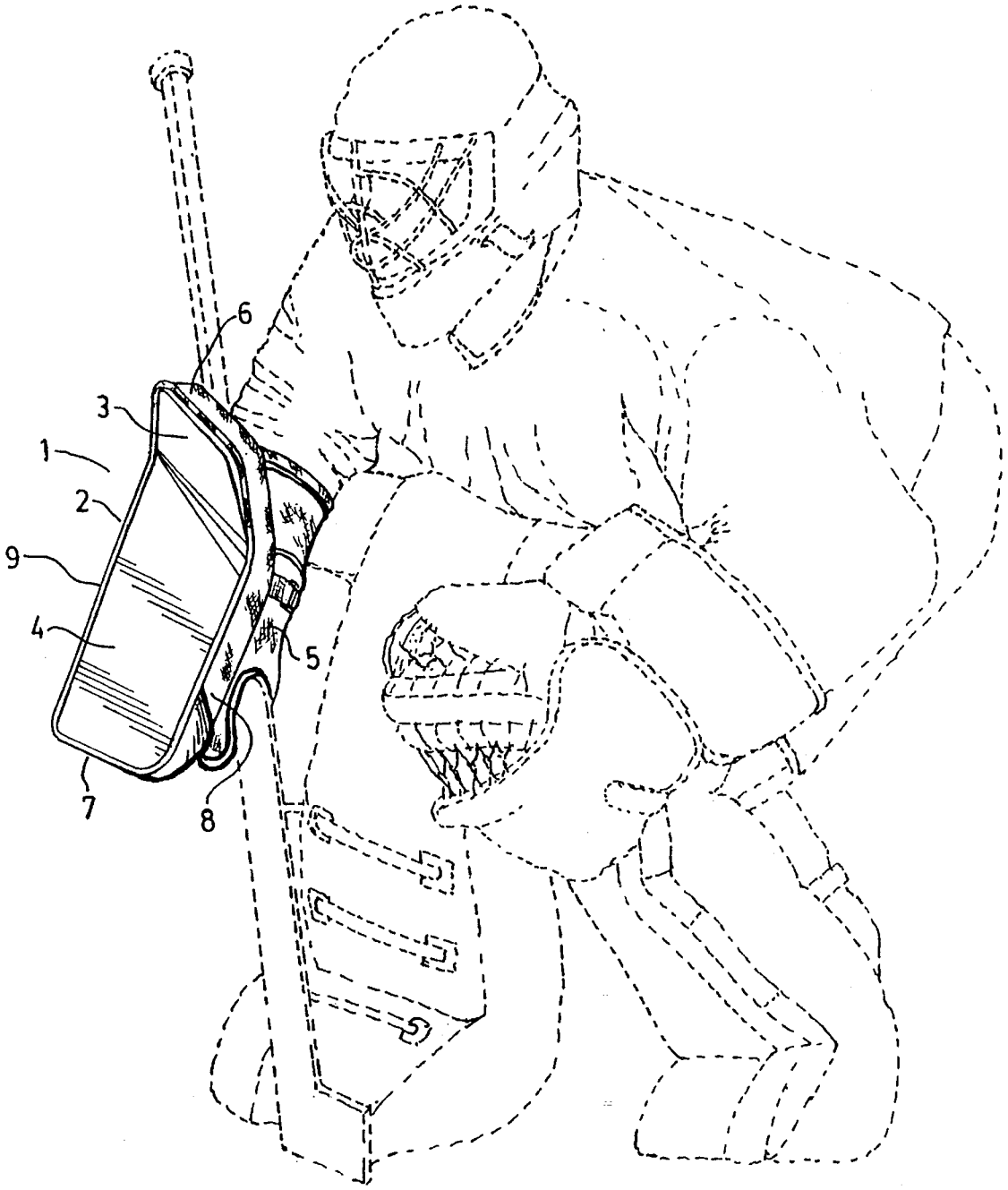
FIG. 1 is a perspective view showing a goaltender wearing the blocker in his normal crouched position, with the blocker generally upright.
Figure 2:
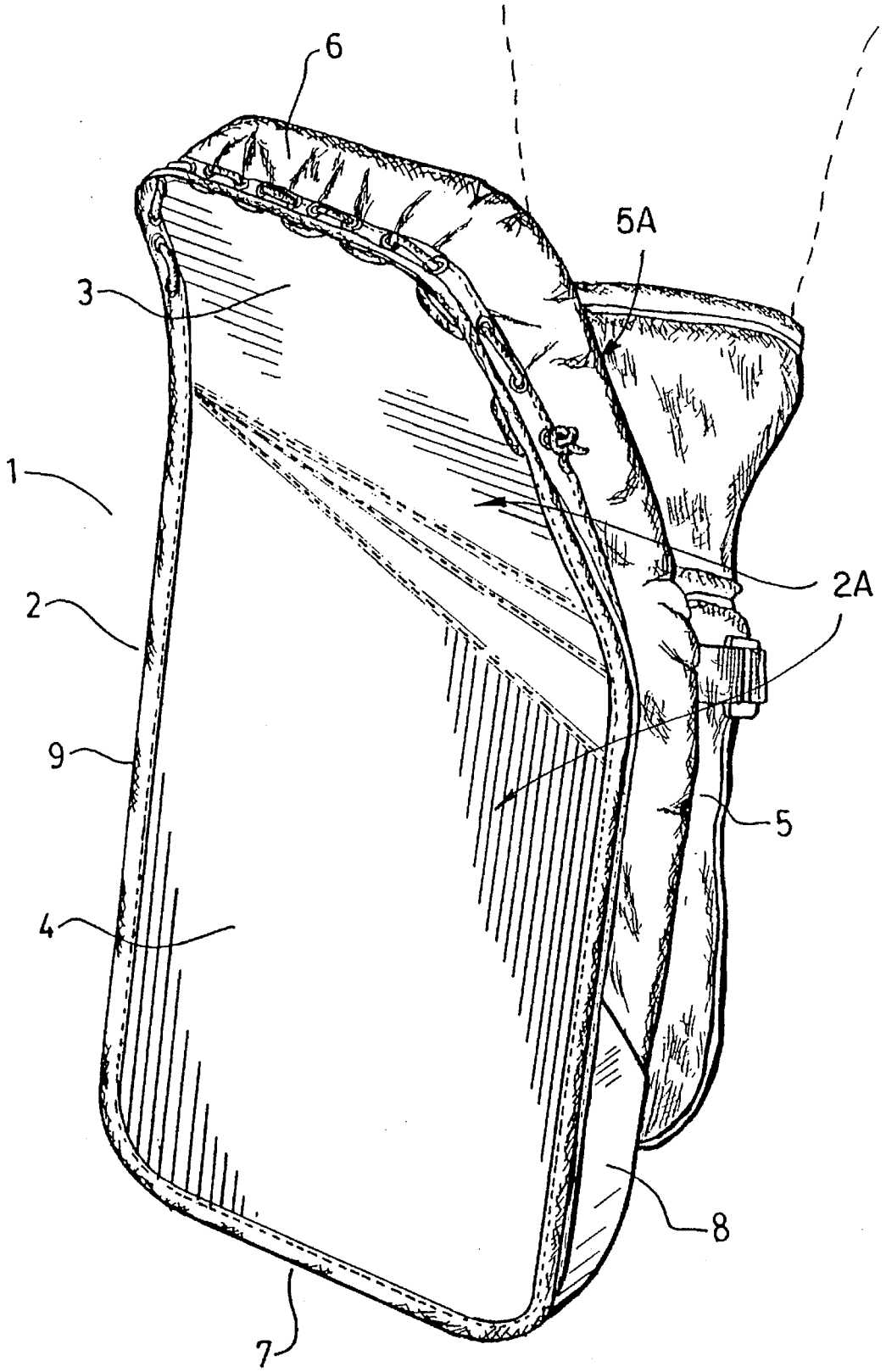
FIG. 2 is a perspective view of the blocker, looking towards the inside edge.
Figure 3:
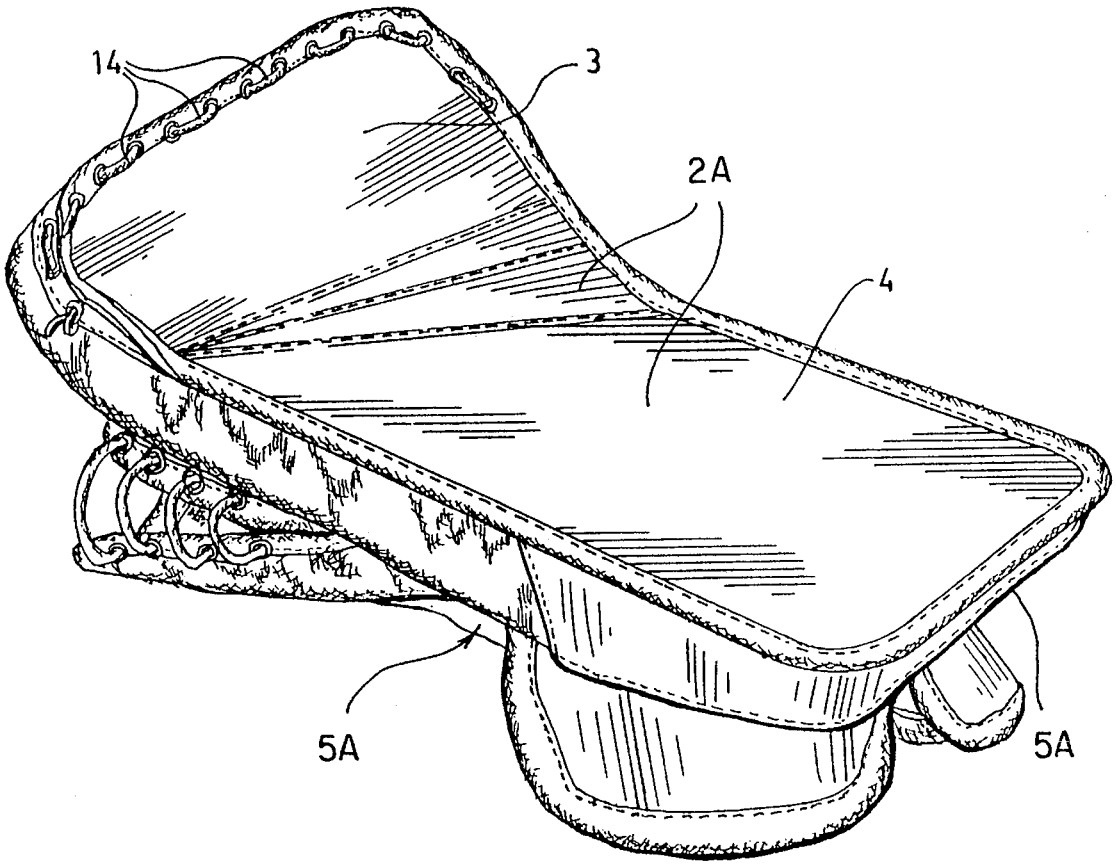
FIG. 3 is another perspective view of the blocker, looking towards the outside edge.

All of the drawings show a right-handed blocker; the left-handed blocker obviously is the mirror image of the illustrated blocker.

DETAILED DESCRIPTION OF THE PREFERRED EMBODIMENT

Referring to the drawings, the invention will now be described in greater detail.

As can be seen readily from FIG. 1, the blocker 1 has a blocking pad 2 with a pluck deflection surface **2*a* comprising an angled upper area 3, angling outwardly from a substantially planar area 4. As is entirely-conventional, the blocker is mounted by way of its inner surface 5*a* on the back of a glove 5**. The term "blocker" may be used to refer to the blocking pad only, but conventionally is often used to refer to both the blocking pad and the glove.

The blocking pad has an upper end 6, a lower end 7, an inside edge 8, and an outside edge 9.

As can be seen most clearly in FIGS. 2, 3, 4 and 5, the angled upper area 3 angles outwardly from the substantially planar surface 4 of the blocking pad, and also towards the outside edge. As mentioned above, the result of this configuration is that when the goaltender is in the usual upright position shown in FIG. 1, with the blocker oriented generally upright, a puck which hits the angled portion of the blocker will be deflected outwardly, i.e. toward the corner of the hockey rink, instead of rebounding in front of the net where there is greater danger of a goal being scored. If the goaltender reaches out away from his body with the blocker, a puck hitting the angled portion will be deflected upwardly and thus out of harm's way. If the goaltender brings the blocker up across his chest (an unusual but possible position), a puck hitting the angled portion will be deflected downwardly, where it may be "smothered" by the goaltender.

Thus, no matter how the blocker is oriented, a puck hitting the angled upper area 3 will be deflected in a more desirable direction than with prior art blockers.

Figure 6:
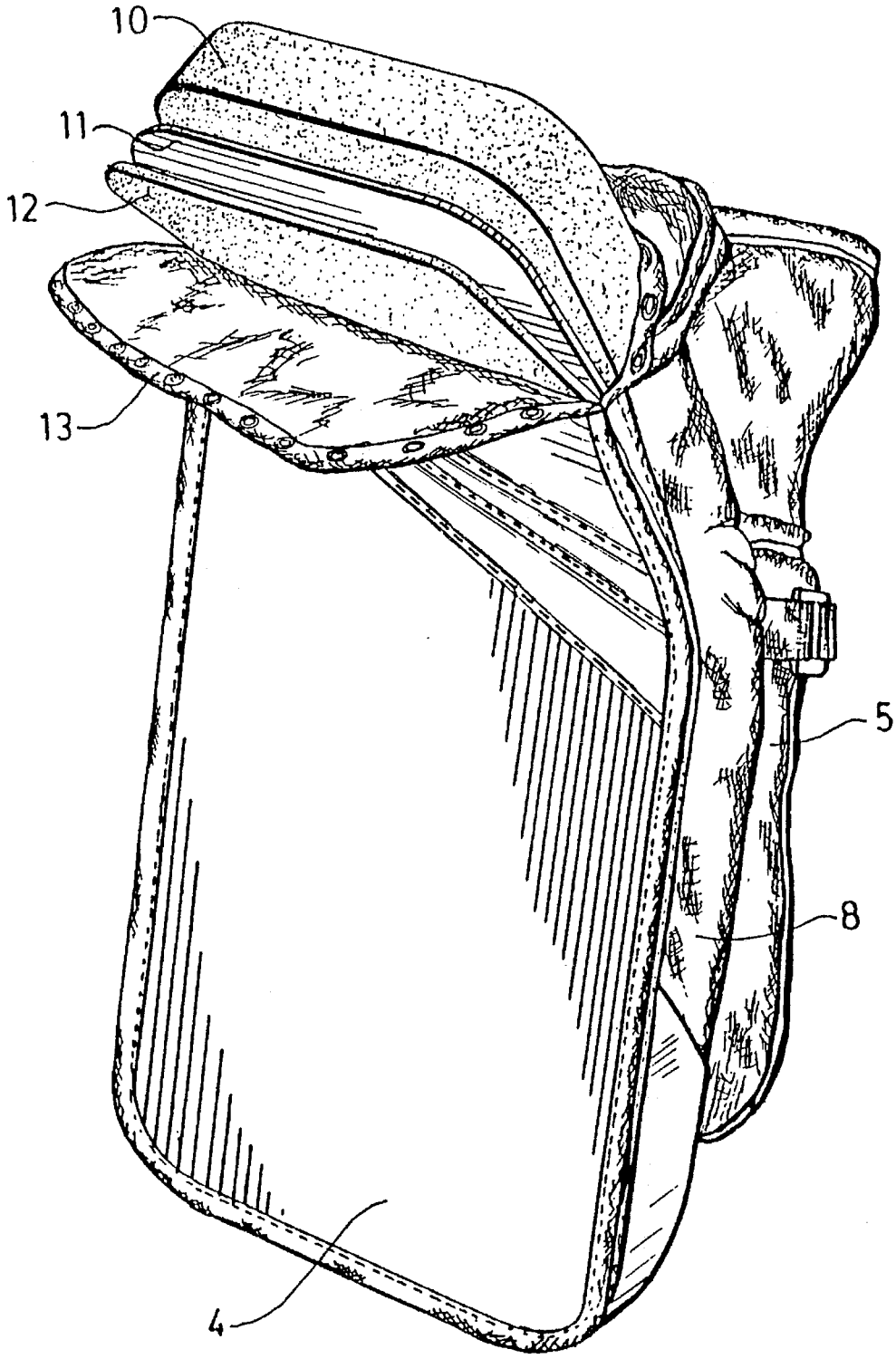
FIG. 6 is a perspective view of the blocker with the outer fabric peeled back to show the construction.

As seen in FIG. 6, the internal structure of the blocking pad is generally conventional. A Styrofoam layer 10, consisting of two pieces bonded together end-to-end to form the shape of the blocking pad, is overlaid by a hard plastic layer 11, and a thin foam layer 12. A fabric cover 13 forms the outer layer. The fabric cover is closed at the upper end by lacing 14.

Figure 7:
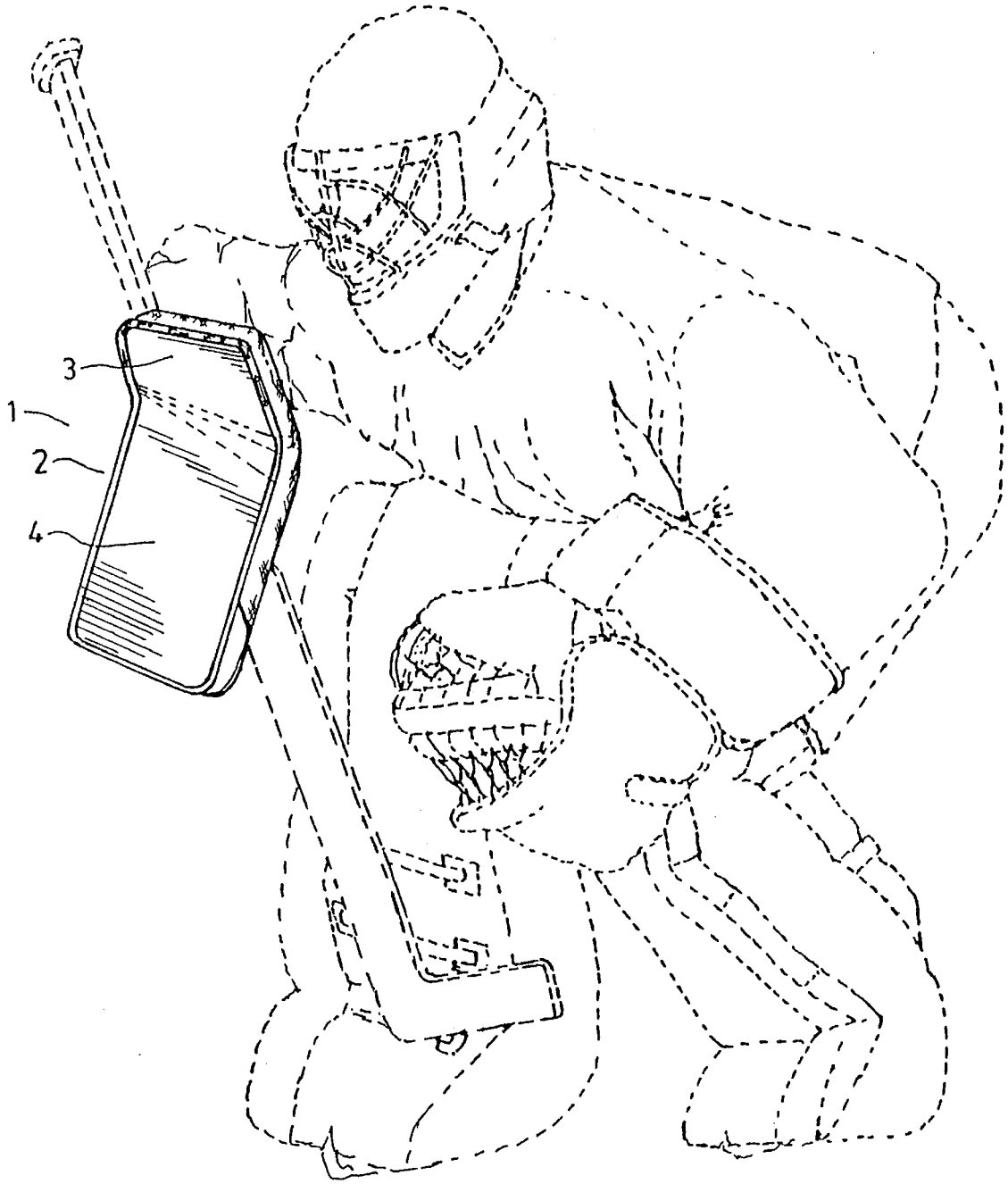
FIG. 7 is a perspective view similar to FIG. 1, but showing the goaltender with the blocker raised towards his shoulder.

As seen in FIG. 7, it is a further advantage of this configuration that if a shot is directed towards the shoulder area on the blocker side, such that the goaltender has to move the blocker up to his shoulder, the angled area is less likely to snag on the goaltender's chest protector or shoulder pads than in the prior art, because the angled area projects away therefrom.

Preferably, as seen most clearly in FIGS. 4 and 5, the angled area angles outwardly away from the planar surface 4 of the blocking pad, preferably at an angle of about 45 degrees from the horizontal, i.e., meets the planar surface at an angle of 135 degrees near the inside edge, and towards the outside edge, preferably at an angle of about 25 degrees from the horizontal, i.e., at an angle of 155 degrees to the planar surface. The angled area 3 preferably accounts for about 25% of the total surface area of the blocker, the portion of the puck deflection surface 2*a* on the angled area 3 being greater near the inside edge 8 than near the outside edge 9.

It will be appreciated that the above description relates to the preferred embodiment by way of example only. Certain variations on the invention will be obvious to those knowledgeable in the field, and such obvious variations are within the scope of the invention as claimed, whether or not expressly described herein.

What is claimed as the invention is:

1. In a hockey goaltender's blocker including a glove and a generally rectangular blocking pad, the pad having an outer puck deflection surface including a substantially planar area, an inner surface fixedly mounted to the glove, a lower end, an upper end, an outside edge, and an inside edge, the improvement comprising:

an upper area of the pad angled outwardly relative to the planar area, the angled upper area including a greater portion of the outer puck deflection surface near the inside edge than near said outside edge such that in operation when said blocker is held by a goaltender in a vertically oriented position, a puck rebounding from the outer puck deflection surface of the angled upper area is deflected to one side of said goaltender.

2. A blocker as claimed in claim 1 wherein said angled upper area meets said substantially planar area at an approximate angle of 135 degrees near said inside edge and at an approximate angle of 155 degrees near said outside edge.

3. A blocker as claimed in claim 1 where in said angled upper area comprises approximately 25% of said outer puck deflection surface.

* * * * *